US010096285B2

(12) United States Patent
Kim

(10) Patent No.: US 10,096,285 B2
(45) Date of Patent: Oct. 9, 2018

(54) DISPLAY DRIVING INTEGRATED CIRCUIT, DISPLAY DEVICE, AND METHOD OF DRIVING A DISPLAY PANEL

(71) Applicant: SAMSUNG DISPLAY CO., LTD., Yongin-si, Gyeonggi-do (KR)

(72) Inventor: Tae-Jin Kim, Bucheon-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 67 days.

(21) Appl. No.: 15/194,599

(22) Filed: Jun. 28, 2016

(65) Prior Publication Data

US 2017/0053597 A1 Feb. 23, 2017

(30) Foreign Application Priority Data

Aug. 17, 2015 (KR) ..... 10-2015-0115637

(51) Int. Cl.

| | |
|---|---|
| ***G09G 3/30*** | (2006.01) |
| ***G09G 3/3266*** | (2016.01) |
| ***G09G 3/3275*** | (2016.01) |
| ***G09G 3/3225*** | (2016.01) |

(52) U.S. Cl.

CPC ..... *G09G 3/3266* (2013.01); *G09G 3/3225* (2013.01); *G09G 3/3275* (2013.01); *G09G 2300/0426* (2013.01); *G09G 2310/0278* (2013.01); *G09G 2310/08* (2013.01); *G09G 2320/0233* (2013.01); *G09G 2320/0285* (2013.01); *G09G 2320/064* (2013.01)

(58) Field of Classification Search

None

See application file for complete search history.

(56) References Cited

U.S. PATENT DOCUMENTS

| | | | | |
|---|---|---|---|---|
| 2002/0047550 | A1 | 4/2002 | Tanada | |
| 2006/0028414 | A1* | 2/2006 | Kimura | G09G 3/006 345/87 |
| 2007/0035485 | A1* | 2/2007 | Yoon | G09G 3/3208 345/76 |
| 2015/0129880 | A1* | 5/2015 | Wu | G09G 3/344 257/72 |
| 2015/0206470 | A1 | 7/2015 | Wu et al. | |

FOREIGN PATENT DOCUMENTS

| | | | |
|---|---|---|---|
| JP | 2009-069768 | A | 4/2009 |
| KR | 10-2006-0030440 | A | 4/2006 |
| KR | 10-2007-0019460 | A | 2/2007 |
| KR | 10-2014-0042623 | A | 4/2014 |

OTHER PUBLICATIONS

European Search Report dated Nov. 9, 2016 in Corresponding European Patent Application No. 16184072.3.

* cited by examiner

*Primary Examiner* — Ifedayo Iluyomade

(74) *Attorney, Agent, or Firm* — Lee & Morse, P.C.

(57) ABSTRACT

A display device includes a display panel, a scan driver, a data driver, and a storage area. The display panel includes data lines, horizontal scan lines, vertical scan lines, pixels at crossing regions of the data and horizontal scan lines, and contact holes that connect the horizontal scan lines to the vertical scan lines. The scan driver provides scan signals to the display panel through the vertical scan lines. The data driver provides data signals to the display panel through the data lines. The storage area stores location information of the contact holes.

20 Claims, 6 Drawing Sheets

DISPLAY DRIVING INTEGRATED CIRCUIT, DISPLAY DEVICE, AND METHOD OF DRIVING A DISPLAY PANEL

CROSS-REFERENCE TO RELATED APPLICATION

Korean Patent Application No. 10-2015-0115637, filed on Aug. 17, 2015, and entitled, "Display Driving Integrated Circuit, Display Device, and Method of Driving A Display Panel," is incorporated by reference herein in its entirety.

BACKGROUND

1. Field

One or more embodiments described herein relate to a display driving integrated circuit, a display device, and a method for driving a display panel.

2. Description of the Related Art

Some organic light emitting displays have a scan driver at a left or right side of a display panel and a data driver at an upper or lower side of the display panel. Other types of organic light emitting displays (e.g., those in a smart watch) have a scan driver at lower side of a display panel. In these and other cases, a stain phenomenon may occur at a point where auxiliary lines are electrically connected to scan lines of the scan driver.

SUMMARY

In accordance with one or more embodiments, a display device includes a display panel including data lines, horizontal scan lines, vertical scan lines, pixels at crossing regions of the data and horizontal scan lines, and contact holes that connect the horizontal scan lines to the vertical scan lines; a scan driver to provide scan signals to the display panel through the vertical scan lines; a data driver to provide data signals to the display panel through the data lines; and a storage area to store location information of the contact holes. The data lines may extend in a first direction, the horizontal scan lines may extend in the first direction, the vertical scan lines may extend in a second direction, and the first direction may cross the second direction.

The display panel may be a circular display panel and the scan driver and the data driver may be arranged in a first direction with respect to the display panel. The storage area may include a look-up table that stores the location information of the contact holes. The look-up table may store first location information of a first group of pixels adjacent to the contact holes.

An (i)th pixel of the first group of pixels may be at a crossing region of an (i)th horizontal scan line of the horizontal scan lines and a (j)th vertical scan line of the vertical scan lines, where i and j are positive integers greater than or equal to 2, and the (i)th horizontal scan line may be electrically connected to the (j)th vertical scan line through an (i)th contact hole of the contact holes. An (i)th location information of the (i)th pixel may include coordinates based on the (i)th horizontal scan line and the (j)th vertical scan line.

The look-up table may store second location information of second group of pixels adjacent to the first group of pixels, and the second group of pixels may include a first neighboring pixel at a crossing region of the (i)th horizontal scan line and a (j−1)th vertical scan line adjacent to the (j)th vertical scan line; and a second neighboring pixel at a crossing region of the (i)th horizontal scan line and a (j+1)th vertical scan line adjacent to the (j)th vertical scan line. The look-up table may store first compensation data to compensate a display-luminance of the first group of pixels. The look-up table may store second compensation data to compensate a display-luminance of the second group of pixels.

The display device may include a timing controller to compensate input data based on the location information of the contact holes and to provide the compensated input data to the data driver. The display panel may include horizontal emission control lines, vertical emission control lines, and emission control line contact holes that connect the horizontal emission control lines to the vertical emission control lines, and the storage area may store location information of the emission control line contact holes. The display device may include an emission driver to provide emission control signals to the display panel through the vertical emission control lines.

In accordance with one or more embodiments, a display driving integrated circuit includes a scan driver to provide a scan signal to a display panel through vertical scan lines that extend in a first direction; a data driver to provide data signals to the display panel through data lines that extend in the first direction; and a storage area to store location information of contact holes that connect the vertical scan lines to horizontal scan lines. The storage area may include a look-up table that stores the location information of the contact holes. The look-up table may store first location information of a first group of pixels adjacent to the contact holes.

An (i)th pixel of the first group of pixels may be at a crossing region of an (i)th horizontal scan line of the horizontal scan lines and a (j)th vertical scan line of the vertical scan lines, where i and j are positive integers greater than or equal to 2, and the (i)th horizontal scan line may be electrically connected to the (j)th vertical scan line through an (i)th contact hole of the contact holes. The look-up table may store second location information of a second group of pixels adjacent to the first group of pixels, and the second group of pixels may include a first neighboring pixel at a crossing region of the (i)th horizontal scan line and a (j−1)th vertical scan line adjacent to the (j)th vertical scan line; and a second neighboring pixel at a crossing region of the (i)th horizontal scan line and a (j+1)th vertical scan line adjacent to the (j)th vertical scan line.

The look-up table may store first compensation data to compensate a display-luminance of the first group of pixels and second compensation data to compensate a display-luminance of the second group of pixels, and the second compensation data may be different from the first compensation data.

In accordance with one or more other embodiments, a method for driving a display panel includes receiving input data; receiving location information of contact holes of the display panel; compensating the input data based on the location information of the contact holes; and generating a data signal based on compensated input data.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
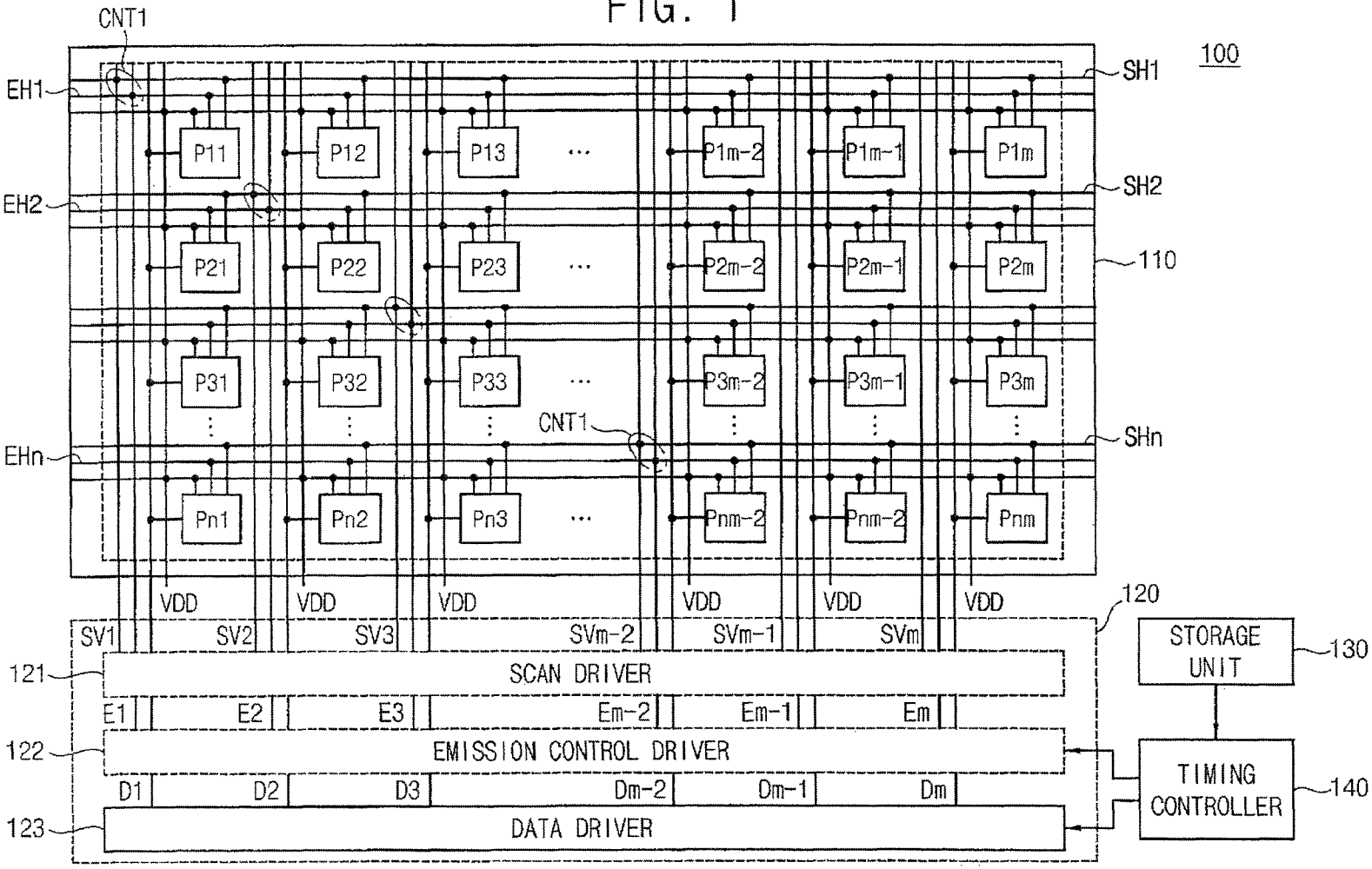
FIG. 1 illustrates an embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of a display device 100 which includes a display panel 110, a display driving integrated circuit 120, a storage unit 130 (or storage area), and a timing controller 140. The display panel 110 includes data lines D1 through Dm, horizontal lines, vertical lines, pixels P11 through Pnm, and contact holes CNT1 through CNTn. The horizontal lines may include horizontal scan lines SH1 through SHn and horizontal emission control lines EH1 through EHn. The vertical lines may include vertical scan lines SV1 through SVm and vertical emission control lines E1 through Em.

In example embodiments, the data lines D1 through Dm may extend in a first direction on the display panel 110, e.g., the data lines D1 through Dm may extend in the first direction substantially parallel to a surface (e.g., an upper surface) of the display panel 110. The vertical scan lines SV1 through SVm may extend in the first direction. The horizontal scan lines SH1 through SHn may extend in a second direction, e.g., substantially parallel to the surface of the display panel 110 and substantially perpendicular to the first direction.

The pixels P11 through Pnm may be located at intersections of the data lines D1 through Dm and the horizontal lines (e.g., the horizontal scan lines SH1 through SHn). Each of the pixels P11 through Pnm may store a data signal in response to a scan signal, and may emit light based on the stored data signal. Each of the pixels P11 through Pnm includes a pixel circuit which has, for example, a 6T1C structure, a 7T1C structure, or another structure.

The contact holes CNT1 through CNTn may electrically connect the horizontal lines to the vertical lines, respectively (e.g., on a one-to-one basis). In some example embodiments, the contact hole CNT1 through CNTn may electrically connect the horizontal scan lines SH1 through SHn to the vertical scan lines SV1 through SVm, respectively. For example, a first contact hole CNT1 may electrically connect a first horizontal scan line SH1 to a second vertical scan line SV1. For example, a second contact hole CNT2 may electrically connect a second horizontal scan line SH2 to a second vertical scan line SV2. For example, an (i)th contact hole CNTi may electrically connect an (i)th horizontal scan line SHi to an (i)th vertical scan line SVi. The display panel 110 may include a number n of contact holes CNT1 through CNTn, where, for example, n is equal to the number of horizontal scan lines SH1 through SHn.

In some example embodiments, the contact holes CNT1 through CNTn may include an emission control line contact holes. The emission control line contact holes may electrically connect the horizontal emission control lines EH1 through EHn with the vertical emission control lines E1 through Em, respectively. For example, a first emission control line contact hole may electrically connect a first horizontal emission control line EH1 with a first vertical emission control line E1.

In FIG. 1, the display panel 110 includes the first contact hole CNT1 and the first emission control line contact hole which are adjacent to each other. The display panel 110 may have a different structure in another embodiment.

In some example embodiments, the display panel 110 may include power lines having a mesh structure. A driving voltage VDD may be supplied to the display panel 110 through the power lines.

The display driving integrated circuit 120 may generate scan signals, emission control signals, and data signals for input into the display panel 110. The display driving integrated circuit 120 may include a scan driver 121, an emission control driver 122, and a data driver 123.

The scan driver 121 may generate the scan signal based on a scan driving control signal, and may provide the scan signal to the display panel through the vertical scan lines SV1 through SVm. The scan driving control signal may include, for example, a start pulse and clock signals. The scan driver 121 may include a shift register sequentially generating the scan signal based on the start pulse and the clock signals.

The emission control driver 122 generates the emission control signals based on an emission driving control signal. The emission control signals are input into the display panel 110 through the vertical emission control lines E1 through Em.

The data driver 123 generates the data signals based on input data. The data signals are input into the display panel 110 through the data lines D1 through Dm in response to a data driving control signal.

The storage unit 130 may store location information of the contact holes CNT1 through CNTn. For example, the storage unit 130 may be a memory device, a register, a look-up table, etc., that stores the location information of the contact holes CNT1 through CNTn. In FIG. 1, the storage unit 130 is a separate device. In another embodiment, the storage unit 130 may be in the display driving integrated circuit 120 or the timing controller 140.

The timing controller 140 controls the display driving integrated circuit 120. The timing controller 140 may generate the scan driving control signal, the emission driving control signal, and the data driving control signal, and may control the display driving integrated circuit 120 based on generated signals.

In some example embodiments, the timing controller 140 may compensate the input data based on the location information of the contact holes CNT1 through CNTn and may provide the compensated input data to the data driver 123. For example, the timing controller 140 may compensate the input data by increasing grayscale values provided to one or more pixels (e.g., an 11th pixel P11, a 22th pixel P22, etc) adjacent to the contact holes CNT1 through CNTn.

In FIG. 1, the timing controller 140 is a separate device. In another embodiment, the timing controller 140 may be in, for example, display driving integrated circuit 120.

In addition, the display device 100 is described to compensate the input data based on the location information of the contact holes CNT1 through CNTn and to provide the compensated input data to the data driver 123 using the timing controller 140. In another embodiment, the display device 100 may generate data signals based on the input data and the location information of the contact holes CNT1 through CNTn using the display driving integrated circuit 120. For example, the display driving integrated circuit 120 may generate data signals which are compensated based on the contact holes CNT1 through CNTn. The pixels P11 through Pnm may emit light based on the compensated data signals.

As described above, the display device 100 may store the location information of the contact holes CNT1 through CNTn that electrically connect the horizontal lines to the vertical lines. The input data may be compensated based on the location information of the contact holes CNT1 through CNTn. Therefore, the display device 100 may prevent a stain phenomenon from occurring due to the contact holes CNT1 through CNTn.

Figure 2:
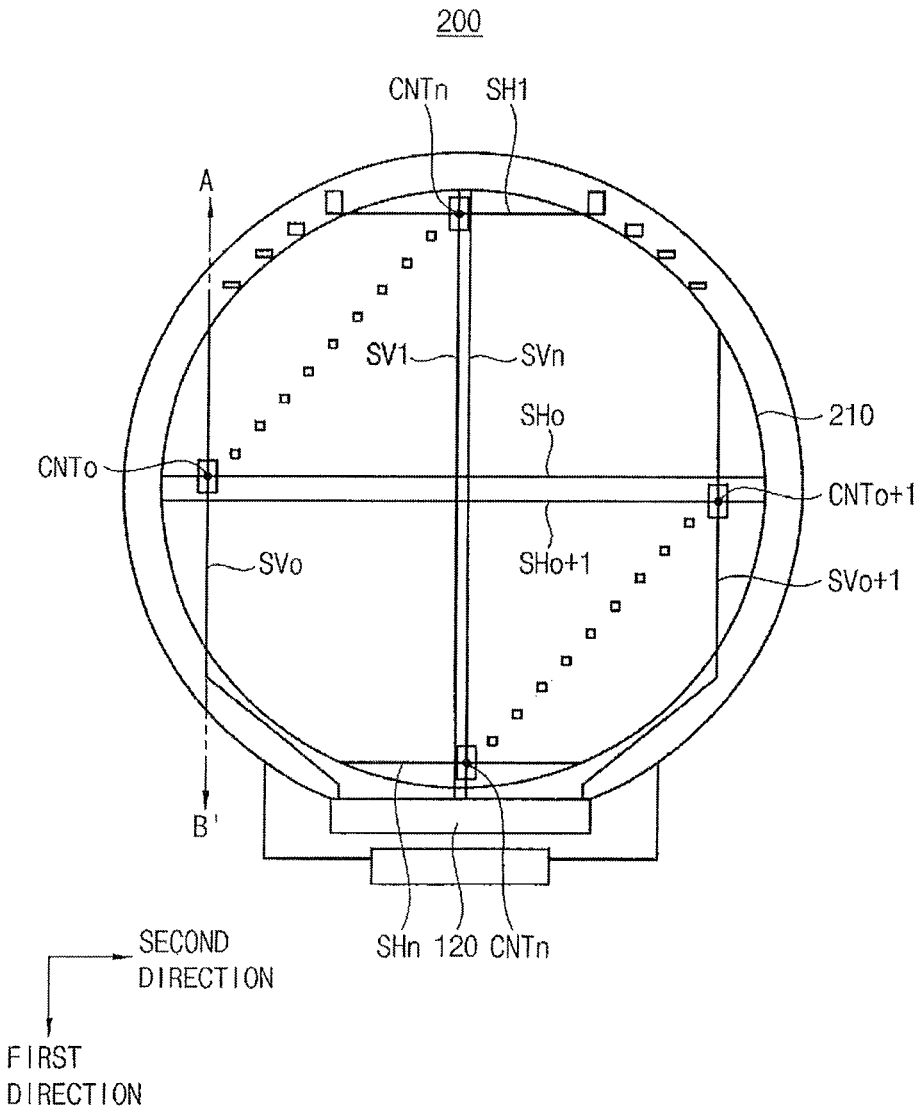
FIG. 2 illustrates an example configuration of the display device.

FIG. 2 illustrates an embodiment of a display device 200 which includes a display panel 210 and a display driving circuit 120. The display panel 210 may be substantially the same as the display panel 110 in FIG. 1. The display panel 210 may be a circular (or round) display or may have another shape. The display panel 210 includes contact holes CNT1 through CNTn that electrically connect horizontal scan lines SH1 through SHn to vertical scan lines SV1 through SNn, respectively.

Locations of the contact holes CNT1 through CNTn in the display panel 210 may be different from locations of the contact holes CNT1 through CNTn in FIG. 1. For example, the vertical scan lines SV1 through SVn may be sequentially arranged from a center of the display panel 210 to a left side of the display panel 210 and from a right side of the display panel 210 to the center of the display panel 210. The contact holes CNT1 through CNTn may be sequentially arranged from the center of the display panel 210 to a left side of the display panel 210 and from the left side of the display panel 210 to the center of the display panel 210. For example, the vertical scan lines SV1 through SVn may be sequentially arranged from the center of the display panel 210 to the right side of the display panel 210 and from the left side of the display panel 210 to the center of the display panel 210. The contact holes CNT1 through CNTn may be sequentially arranged from the center of the display panel 210 to the right side of the display panel 210 and from the left side of the display panel 210 to the center of the display panel 210.

The display driving integrated circuit 120 may be arranged in a first direction side of the display panel 210. For example, the scan driver 121 and the data driver 123 may be arranged in the first direction side (e.g., a lower side) of the display panel 210.

The display panel 210 may further include horizontal emission control lines, vertical emission control lines, and emission control line contact holes. The emission control line contact holes may electrically connect the horizontal emission control lines to the vertical emission control lines, respectively. The horizontal emission control lines may be substantially the same as or similar to the horizontal scan lines SH1 through SHn and may transfer the emission control signals instead of the scan signals. The configuration of the vertical emission control lines may be substantially the same as or similar to a configuration of the vertical scan lines SV1 through SVn. The configuration of the emission control line contact holes may be substantially the same as or similar to a configuration of the contact holes CNT1 through CNTn.

Figure 3:
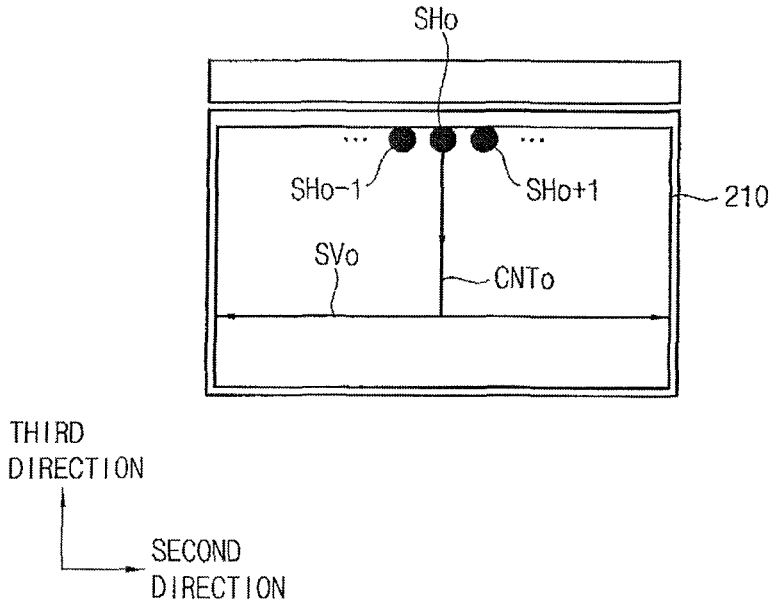
FIG. 3 illustrates a cross-sectional view of a display panel in the display device.

FIG. 3 is a cross sectional view of an embodiment of the display panel 200. Referring to FIG. 3, the display panel 210 may include a (o)th contact hole CNTo that connects a (o)th horizontal scan line SHo to a (o)th vertical scan line SVo. The (o)th horizontal scan line SHo extends in the first direction, the (o)th vertical scan line SVo extends in the second direction, and the (o)th contact hole CNTo extends in a third direction. The third direction may be substantially perpendicular to the first direction and the second direction, e.g., the third direction may be perpendicular to a surface (e.g., an upper surface) of the display panel 210.

The display panel 210 may include, for example, a line structure (or wiring structure) having a T-shape between the horizontal scan lines SH1 through SHn and the vertical scan lines SV1 through SVn. The line structure of the T-shape may form a parasitic capacitance (or a parasitic capacitor) between one or more horizontal scan lines and/or one or more vertical scan lines electrically connected to a corresponding contact hole. A same data signal may be provided to a pixel (or pixels) adjacent to the corresponding contact hole and other pixels (e.g., pixels except the pixel adjacent to the contact hole). In one embodiment, the pixel adjacent to the corresponding contact hole may emit a light with a different luminance (e.g., a lower luminance) from other pixels.

Figure 4:
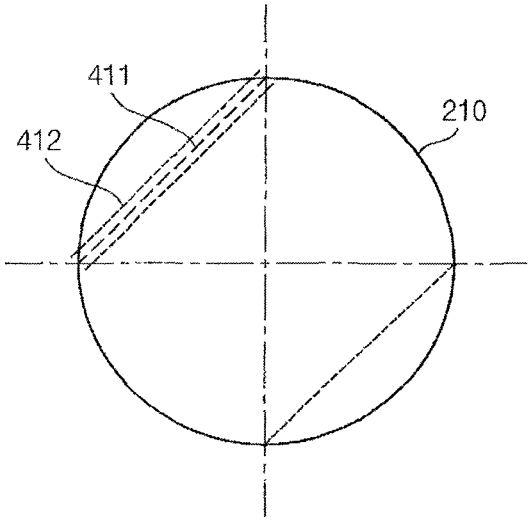
FIG. 4 illustrates an example of a stain phenomenon.

FIG. 4 illustrates an example of a stain phenomenon which may occur in a display device. Referring to FIG. 4, data signals, which are the same as each other, may be provided to the display panel 210. A first oblique line 411 (or diagonal line corresponding to a stain phenomenon) may occur at areas of the contact holes CNT1 through CNTn. For example, the first oblique line 411 may coincide with locations of the contact holes CNT1 through CNTn or corresponding to locations of pixels located adjacent to the contact holes CNT1 through CNTn.

The first oblique line 411 may have one luminance, e.g., the pixels adjacent to the contact holes CNT1 through CNTn may emit light with the same or similar luminance. Because the contact holes CNT1 through CNTn (or line structures that connect the horizontal scan lines SH1 through SHn to the vertical scan lines SV1 through SVn) may have the same or similar structure, the contact holes CNT1 through CNTn may produce the same or similar effect to pixels adjacent to the contact holes CNT1 through CNTn.

A second oblique line 412 having a different luminance from the first oblique line 411 may also occur. The second oblique line 412 may have a luminance higher than the luminance of the first oblique line 411 or may have a luminance lower than the luminance of other areas (e.g., an area of display panel 210 except the first oblique line 411 and the second oblique line 412). The first oblique line 411 may be represented by first group of pixels adjacent to the contact holes CNT1 through CNTn, The second oblique line 412 may be represented by second group of pixels adjacent to the first group of pixels.

As described with reference to FIG. 4, a stain phenomenon may occur by the contact holes CNT1 through CNTn. For example, an uniform luminance reduction may occur at pixels corresponding (or located adjacent) to the contact holes CNT1 through CNTn. Therefore, the display device 100 may compensate input data or data signals based on information (e.g., location information) of the contact holes CNT1 through CNTn. The stain phenomenon caused by the contact holes CNT1 through CNTn may be therefore be reduced or prevented and thus display quality may be improved.

Figure 5:
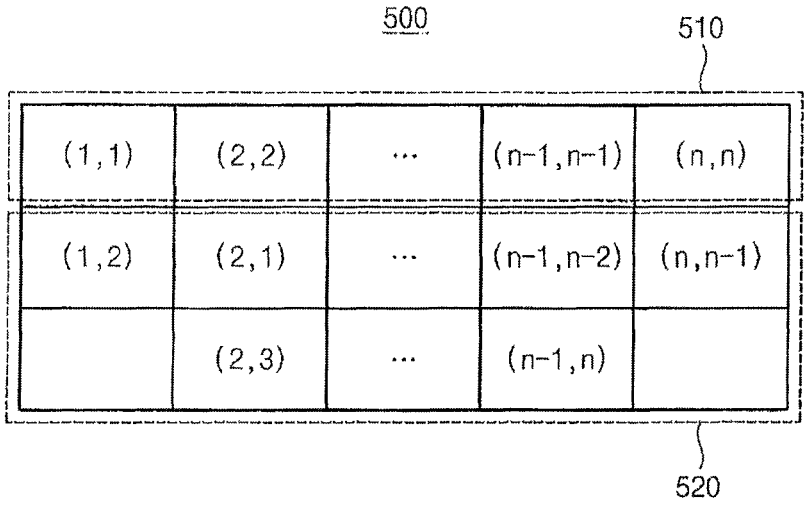
FIG. 5 illustrates an example of a look-up table in the display device.
Figure 6:
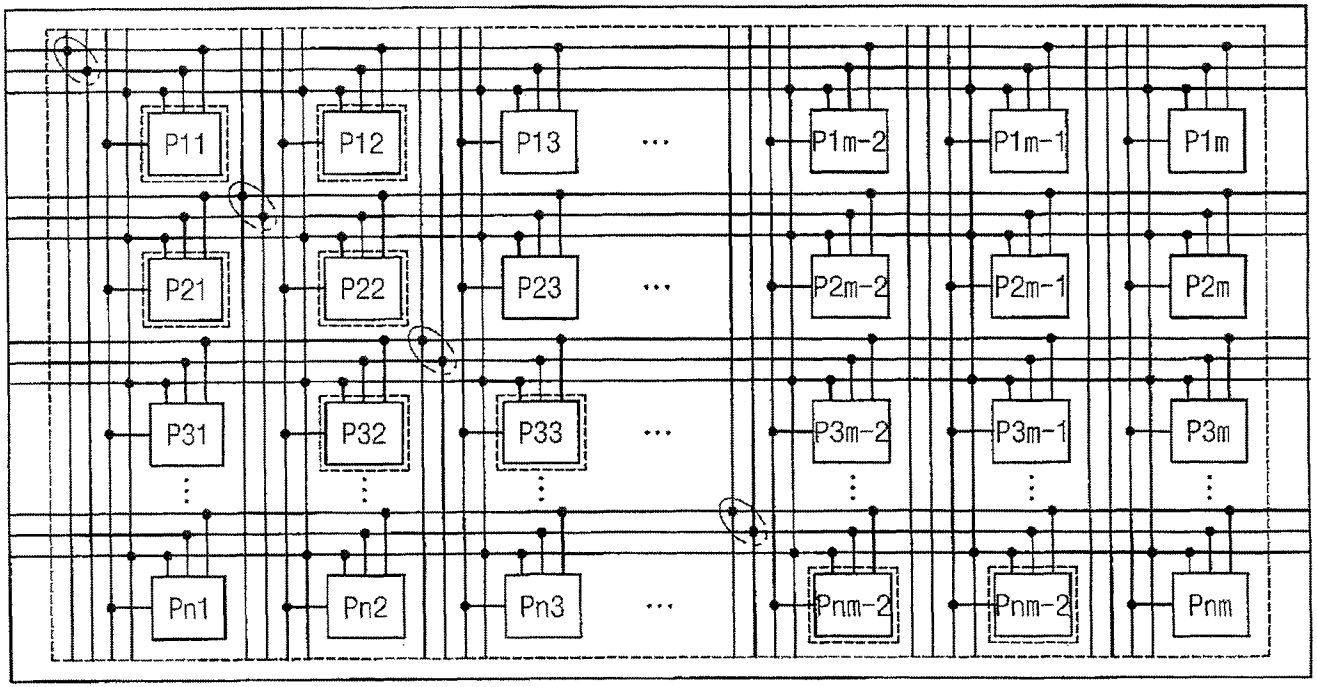
FIG. 6 illustrates an example of a display panel in the display device.

FIG. 5 illustrates an example of a look-up table, which, for example, may be used in accordance with any of the aforementioned embodiments of the display device. FIG. 6 illustrates an example of a display panel in the display device. For illustrative purposes, the display device 100 in FIG. 1 will be discussed.

Referring to FIGS. 1, 5, and 6, the look-up table 500 stores location information of the contact holes CNT1 through CNTn. The location information of the contact holes CNT1 through CNTn may be represented by coordinates of the contact holes CNT1 through CNTn on the display panels. For example, when the first contact hole CNT1 electrically connects the first horizontal scan line SH1 to the first vertical scan line SV1, location information of the first contact hole CNT1 may be represented as (1, 1) based on an order (an arranged order) of the first horizontal scan line SH1 and an order or the first vertical scan line SV1. For example, when the first contact hole CNT1 electrically connects the first horizontal scan line SH1 to the second vertical scan line SV2, location information of the first contact hole CNT1 may be represented as (1, 2) based on an order (or, an arranged order) of the first horizontal scan line SH1 and an order or the second vertical scan line SV2.

In some example embodiments, the look-up table 500 may store location information 510 of the first group of pixel P11, P22, P33, and Pnm-2 adjacent to the contact holes CNT1 through CNTn. Here, an (i)th pixel of the first group of pixels P11, P22, P33, and Pnm-2 may be located at a crossing region of an (i)th horizontal scan line SHi and a (j)th vertical scan line SVj electrically connected to the (i)th contact hole CNTi. Location information of the (i)th pixel may be represented in the form of coordinates based on the (i)th horizontal scan line SHi and the (j)th vertical scan line SVj. For example, the second pixel P22 of the first group of pixels P11, P22, P33, and Pnm-2 may be located at a crossing region of a second horizontal scan line SH2 and a second vertical scan line SV2. Location information of the second pixel P22 (or second location information) may be (2, 2).

In some example embodiments, the look-up table 500 may store location information 520 of the second group of pixels P12, P21, P23, P32, and Pnm-1 adjacent to the first group of pixels P11, P22, P33, and Pnm-2 (or the contact holes CNT1 through CNTn). As described above, the (i)th pixel of the first group of pixels P11, P22, P33, and Pnm−2 may be located at a crossing region of the (i)th horizontal scan line SHi and the (j)th vertical scan line SVj electrically connected to the (i)th contact hole CNTi.

The second group of pixels P12, P21, P23, P32, and Pnm-1 may include a first neighboring pixel at a crossing region of the (i)th horizontal scan line SHi and a (j−1)th vertical scan line SVj−1. The second group of pixels P12, P21, P23, P32, and Pnm-1 may include a second neighboring pixel at a crossing region of the (i)th horizontal scan line SHi and a (j+1)th vertical scan line SVj+1. For example, when the first group of pixels P11, P22, P33, and Pnm-2 includes a second pixel P22, the second group of pixels P12, P21, P23, P32, and Pnm-1 may include a first neighboring pixel P21 and a second neighboring pixel P23 adjacent to the second pixel P22. The first neighboring pixel P21 (or the second neighboring pixel P23) may be electrically connected to the second scan line SH2 that is electrically connected to the second pixel P22, and may be electrically connected to the first vertical scan line SV1 (or a third vertical scan line SV3) adjacent to the second vertical scan line SV2 that is electrically connected to the second pixel P22. Therefore, the look-up table 500 may store (2, 1) as location information of the first neighboring pixel P21 and/or (2, 3) as location information of the second neighboring pixel P23.

Similarly, the look-up table 500 may store (n−1, n−1) of location information of a (n−1)th pixel and may store (n−1, n−2) of location information of a first neighboring pixel adjacent to the (n−1)th pixel and/or (n−1, n) as location information of a second neighboring pixel adjacent to the (n−1)th pixel.

In some example embodiments, the look-up table 500 may store first compensation data for compensating a display-luminance of the first group of pixels P11, P22, P23, and Pnm-2. As described with reference to FIG. 4, the first group of pixels P11, P22, P33, and Pnm-2 may have a same luminance reduction and the look-up table 500 may store one of the first compensation data for compensating the same luminance reduction. The first compensation data may be, for example, a grayscale value or a compensation ratio to compensate luminance reduction.

In some example embodiments, the look-up table 500 may store second compensation data for compensating a display-luminance of the second group of pixels P12, P21, P23, P32, and Pnm-1. As described with reference to FIG. 4, a luminance reduction of the second group of pixels P12, P21, P23, P32, and Pnm-1 may be different from the luminance reduction of the first group of pixels P11, P22, P33, and Pnm-2. The look-up table 500 may store the second compensation data different from the first compensation data. For example, the second compensation data may be a grayscale value or a compensation ratio to compensate the luminance reduction of the second group of pixels P12, P21, P23, P32, and Pnm-1.

As described above, the look-up table 500 may store location information of the contact holes CNT1 through CNTn and location information of the first group of pixels P11, P22, P33, and Pnm-2 adjacent to the contact holes CNT1 through CNTn. In addition, the look-up table 500 may store location information of the second group of pixels P12, P21, P23, P32, and Pnm-1 adjacent to the first group of pixels P11, P22, P33, and Pnm-2 (or the contact holes CNT1 through CNTn). Therefore, the display device 100 may compensate input data provided, for example, from an external source or may generate compensated data signal based on the location information (e.g., location information of the contact holes CNT1 through CNTn) stored in the look-up table 500.

The look-up table 500 in FIG. 5 stores the location information of the contact holes CNT1 through CNTn in the display device 100. In another embodiment, the look-up table 500 may store the location information of the contact holes CNT1 through CNTn in the display device 200 of FIG. 2. The location information of the contact holes CNT1 through CNTn stored in the look-up table 500 may be different from location information in FIG. 5.

Figure 7:
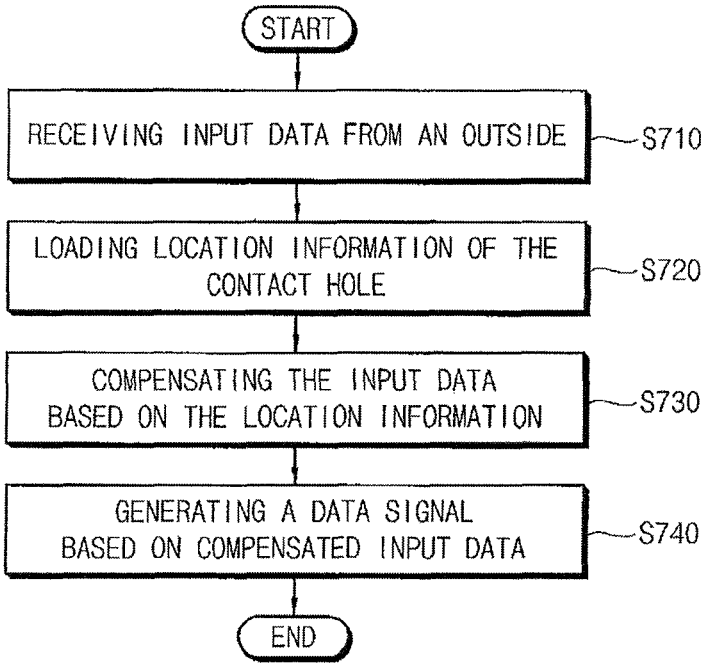
FIG. 7 illustrates an embodiment of a method for driving a display panel.

FIG. 7 illustrates an embodiment of a method for driving a display panel, which, for example, may be any of the aforementioned embodiments. For illustrative purposes, the method will be described as driving display device 100 of FIG. 1.

The method includes receiving input data from external source (S710). The input data may be received, for example, when the display device 100 is powered on. Then, location information of the contact holes CNT1 through CNTn may be received (S720). The location information of the contact holes CNT1 through CNTn may be loaded, for example, from the storage unit 130. As described with reference to FIGS. 1 and 5, the storage unit 130 may include the look-up table 500 that stores the location information of the contact holes CNT1 through CNTn. The stored information (e.g., location information of the contact holes CNT1 through CNTn) may be loaded from the look-up table 500.

Input data may then be compensated based on the location information of the contact holes CNT1 through CNTn (S730). For example, grayscale values (e.g., of the input data) of pixels (e.g., the first group of pixels P11, P22, P33, and Pnm-2 in FIG. 6) adjacent to the contact holes CNT1 through CNTn may be compensated based on the first compensation data. The first compensation data may be stored in the look-up table 500 as described with reference to FIG. 6.

For example, the method may compensate grayscale values of pixels (e.g., the second group of pixels P12, P21, P23, P32, and Pnm-1 in FIG. 6) adjacent to the first group of pixels P11, P22, P33, and Pnm-2 (or, the contact holes CNT1 through CNTn) based on the second compensation data.

Data signals may be generated based on compensated input data (S740). The data signals may be generated by the display driving integrated circuit 120 for input into to the display panel 110. Because the pixels P11 through Pnm emit light based on the data signals (e.g., the compensated data signals), a stain phenomenon due to the contact holes CNT1 through CNTn may be reduced or prevented on the display panel 110.

In some example embodiments, the method may include generating data signals based on the location information of the contact holes CNT1 through CNTn, instead of compensating input data based on the location information of the contact holes CNT1 through CNTn. For example, the method of FIG. 7 may compensate data voltages (e.g., data signals) to be provided to the pixels (e.g., the first group of pixels P11, P22, P33, and Pnm-2 in FIG. 6) adjacent to the contact holes CNT1 through CNTn based on the first compensation data. For example, the method may compensate data voltages for the pixels (e.g., the second group of pixels P12, P21, P23, P32, and Pnm-1 in FIG. 6) adjacent to the first group of pixels P11, P22, P33, and Pnm-2 (or, the contact holes CNT1 through CNTn) based on the second compensation data.

As described above, the method may compensate input data based on location information of the contact holes CNT1 through CNTn and may generate data signals based on the compensated input data. Therefore, the method of FIG. 7 may reduce or prevent a stain phenomenon from occurring due to the contact holes CNT1 through CNTn and thus may improve display quality.

The aforementioned embodiments may be applied to any one of a variety of display devices, e.g., organic light emitting display devices, liquid crystal display devices, etc. The aforementioned embodiments may also be applied to a variety of electronic devices, including but not limited to a television, a computer monitor, a laptop, a digital camera, a cellular phone, a smart phone, a personal digital assistant (PDA), a portable multimedia player (PMP), an MP3 player, a navigation system, and a video phone.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The compensation, control, and other processing features of the embodiments described herein may be implemented in logic which, for example, may include hardware, software, or both. When implemented at least partially in hardware, the compensation, control, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the compensation, control, and other processing operations may be performed in accordance with, for example, code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, a display device in a smart watch includes a scan driver at a lower side of a display panel and auxiliary lines (vertical scan lines) for connecting scan lines that extend in a horizontal direction with the scan driver. In this case, a stain phenomenon may occur near connection points that electrically connect the scan line to the auxiliary lines.

In accordance with one or more of the aforementioned embodiments, a display driving integrated circuit (or data driver) includes a memory device that stores location information of one or more contact holes that electrically connect horizontal line(s) with vertical line(s). The display driving integrated circuit compensates input data based on the location information. The display driving IC may include compensation data to compensate the input data to be provided to the pixels. The compensation data may be predetermined and may compensate the input data by summing the input data with the compensation data.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments as set forth in the following claims.

What is claimed is:

1. A display device, comprising:

a display panel including data lines, horizontal scan lines, vertical scan lines, pixels at crossing regions of the data and horizontal scan lines, and contact holes that connect the horizontal scan lines to the vertical scan lines;

a scan driver to provide scan signals to the display panel through the vertical scan lines;

a data driver to provide data signals to the display panel through the data lines;

a storage area to store location information of the contact holes; and a controller to compensate input data based on the location information of the contact holes stored in the storage area and to provide the compensated input data to the data driver.

2. The display device as claimed in claim 1, wherein:

the data lines extend in a first direction, the horizontal scan lines extend in the first direction, the vertical scan lines extend in a second direction, and the first direction crosses the second direction.

3. The display device as claimed in claim 1, wherein:

the display panel is a circular display panel, and the scan driver and the data driver are arranged in a first direction with respect to the display panel.

4. The display device as claimed in claim 1, wherein the storage area includes a look-up table that stores the location information of the contact holes.

5. The display device as claimed in claim 4, wherein the look-up table stores first location information of a first group of pixels adjacent to the contact holes.

6. The display device as claimed in claim 5, wherein:

an (i)th pixel of the first group of pixels is at a crossing region of an (i)th horizontal scan line of the horizontal scan lines and a (j)th vertical scan line of the vertical scan lines, where i and j are positive integers greater than or equal to 2, and the (i)th horizontal scan line is electrically connected to the (j)th vertical scan line through an (i)th contact hole of the contact holes.

7. The display device as claimed in claim 6, wherein an (i)th location information of the (i)th pixel includes coordinates based on the (i)th horizontal scan line and the (j)th vertical scan line.

8. The display device as claimed in claim 6, wherein:

the look-up table stores second location information of a second group of pixels adjacent to the first group of pixels, and the second group of pixels includes:

a first neighboring pixel at a crossing region of the (i)th horizontal scan line and a (j−1)th vertical scan line adjacent to the (j)th vertical scan line; and a second neighboring pixel at a crossing region of the (i)th horizontal scan line and a (j+1)th vertical scan line adjacent to the (j)th vertical scan line.

9. The display device as claimed in claim 8, wherein the look-up table stores first compensation data to compensate a display luminance of input data corresponding to the first group of pixels.

10. The display device as claimed in claim 8, wherein the look-up table stores second compensation data to compensate a display luminance of input data corresponding to the second group of pixels.

11. The display device as claimed in claim 1, wherein the controller is a timing controller.

12. The display device as claimed in claim 1, wherein:

the display panel includes horizontal emission control lines, vertical emission control lines, and emission control line contact holes that connect the horizontal emission control lines to the vertical emission control lines, and the storage area stores location information of the emission control line contact holes.

13. The display device as claimed in claim 12, further comprising:

an emission driver to provide emission control signals to the display panel through the vertical emission control lines.

14. A display driving integrated circuit, comprising:

a scan driver to provide a scan signal to a display panel through vertical scan lines that extend in a first direction;

a data driver to provide data signals to the display panel through data lines that extend in the first direction; and a storage area to store location information of contact holes that connect the vertical scan lines to horizontal scan lines and compensation data to compensate input data based on the location information of the contact holes.

15. The display driving integrated circuit as claimed in claim 14, wherein the storage area includes a look-up table that stores the location information of the contact holes.

16. The display driving integrated circuit as claimed in claim 15, wherein the look-up table stores first location information of a first group of pixels adjacent to the contact holes.

17. The display driving integrated circuit as claimed in claim 16, wherein:

an (i)th pixel of the first group of pixels is at a crossing region of an (i)th horizontal scan line of the horizontal scan lines and a (j)th vertical scan line of the vertical scan lines, where i and j are positive integers greater than or equal to 2, and the (i)th horizontal scan line is electrically connected to the (j)th vertical scan line through an (i)th contact hole of the contact holes.

18. The display driving integrated circuit as claimed in claim 17, wherein:

the look-up table stores second location information of a second group of pixels adjacent to the first group of pixels, and the second group of pixels includes:

a first neighboring pixel at a crossing region of the (i)th horizontal scan line and a (j−1)th vertical scan line adjacent to the (j)th vertical scan line; and a second neighboring pixel at a crossing region of the (i)th horizontal scan line and a (j+1)th vertical scan line adjacent to the (j)th vertical scan line.

19. The display driving integrated circuit as claimed in claim 18, wherein:

the look-up table stores first compensation data to compensate a display luminance of the first group of pixels and second compensation data to compensate a display luminance of the second group of pixels, and the second compensation data is different from the first compensation data.

20. A method for driving a display panel, the method comprising: receiving input data; receiving location information of contact holes of the display panel; determining compensation data based on the location information; compensating the input data based on the compensation data that corresponds to the location information of the contact holes stored in a storage area, wherein the contact holes connect horizontal scan lines to vertical scan lines; and generating a data signal based on compensated input data.

* * * * *